US005959590A

United States Patent [19]

Sanford et al.

[11] Patent Number: 5,959,590

[45] Date of Patent: Sep. 28, 1999

[54] LOW SIDELOBE REFLECTOR ANTENNA SYSTEM EMPLOYING A CORRUGATED SUBREFLECTOR

[75] Inventors: John R. Sanford, Palo Alto; Raymond R. Blasing, Los Altos, both of Calif.; Ahmed A. Kishk, Oxford, Miss.

[73] Assignee: Endgate Corporation, Sunnyvale, Calif.

[21] Appl. No.: 08/695,286

[22] Filed: Aug. 8, 1996

[51] Int. Cl.[6] ..... H01Q 19/19

[52] U.S. Cl. ..... 343/781 CA; 343/781 P; 343/781 R

[58] Field of Search ..... 343/781 P, 781 CA, 343/914, 779, 781 R, 782, 783; H01Q 19/19, 15/16, 15/18, 15/14

[56] References Cited

U.S. PATENT DOCUMENTS

| | | | |
|---|---|---|---|
| 2,698,901 | 1/1955 | Wilkes | 250/33.63 |
| 2,829,366 | 4/1958 | Armstrong | 343/781 |
| 3,055,004 | 9/1962 | Cutler | 343/781 |
| 3,983,560 | 9/1976 | MacDougall | 343/781 |
| 4,188,632 | 2/1980 | Knox | 343/753 |
| 4,503,435 | 3/1985 | Dragone | 343/781 P |
| 4,626,863 | 12/1986 | Knop et al. | 343/781 |
| 4,673,945 | 6/1987 | Syrigos | 343/755 |
| 4,673,947 | 6/1987 | Newham | 343/781 |
| 4,827,277 | 5/1989 | Becker et al. | 343/781 P |
| 4,963,878 | 10/1990 | Kildal | 343/781 |
| 4,982,198 | 1/1991 | Shafai et al. | 343/818 |
| 5,302,962 | 4/1994 | Rebuffi et al. | 343/781 P |
| 5,606,334 | 2/1997 | Amarllsas et al. | 343/914 |

FOREIGN PATENT DOCUMENTS

| | | | |
|---|---|---|---|
| 2540297 | 8/1984 | France | 343/781 P |
| 200178 | 3/1983 | German Dem. Rep. | 343/781 P |

OTHER PUBLICATIONS

Panicali et al, "A reflector Antenna Corrected for Spherical, Coma and Chromatic", Proc. of IEEE, vol. 59, No. 2 Feb. 1971, pp. 311–312.

*Primary Examiner*—Hoanganh Le
*Attorney, Agent, or Firm*—Cooley Godward LLP

[57] ABSTRACT

An improved subreflector antenna with lower sidelobes than prior art subreflector antennas is disclosed herein. A tapered, anisotropic, corrugated subreflector is attached to a waveguide and located at the focus of a near-parabolic deep dish main reflector. The subreflector has corrugations of varying depth. The varying depths of the corrugations result in varying reactance, or reactance taper, of the subreflector. This taper is designed in such a manner to guide or steer the energy from the antenna feed to the main reflector in such a manner as to help assure sharply reduced sidelobes. Further, the subreflector is physically shaped so as to further steer or guide the energy in the desired direction. The deep geometry of the main reflector allows the reduced sized subreflector to be positioned within the rim of the main reflector such that the combination can be covered by a flat radome.

2 Claims, 4 Drawing Sheets

LOW SIDELOBE REFLECTOR ANTENNA SYSTEM EMPLOYING A CORRUGATED SUBREFLECTOR

FIELD OF THE INVENTION

This invention relates to an improved reflector antenna which maintains a low sidelobe envelope, without the use of an absorbing cylinder. The invention uses a circular waveguide feed employing a non-planar, corrugated subreflector that concentrates the energy from the waveguide onto the main reflector without allowing it to pass directly to the far field of the antenna. It is substantially smaller than comparable feeds and hence reduces blockage by the subreflector.

BACKGROUND OF THE INVENTION

A splash plate reflector antenna is characterized by a flat, planar metal surface that reflects power radiated from a waveguide, or feed tube, to a main reflector. Such an antenna employing a corrugated splash plate is sometimes referred to as a "Hat Feed" antenna. The present invention builds upon the hat feed antenna seen in U.S. Pat. No. 4,963,878 to Per-Simon Kildal. The goal of the Kildal hat feed design was to produce equal E- and H-plane patterns. It was later observed in the paper by J. P. Hansen, A. A. Kishk, P. S. Kildal and O. Dahlsjo entitled "High Performance Reflector Hat Antenna With Very Low Sidelobes For Radio Link Applications," Antenna and Propagation Symposium Proceedings, July 1995, Newport Beach, Calif., that Kildal's feed could be used for low sidelobe antenna design. This is because the feed has a very smooth primary pattern and low sidelobes. Our invention builds upon this design. It uses a main reflector that subtends a large portion of the feed pattern (approximately 110 degrees). The feed pattern has a large edge taper on the reflector (−20 db) that in turn gives a very low sidelobe radiation pattern without use of an absorbing cylinder. In place of the splash plate, a subreflector which is tapered rather than flat and having varied depth of its corrugations helps guide the energy from the feed to the main reflector along a path which insures improved low sidelobes. The feed geometry is much smaller than that described in the above patent and thus has less subreflector blockage. Further the feed tube is much shorter.

SUMMARY OF THE INVENTION

The quality of an antenna is judged by a number of factors. The most important are gain, sidelobe envelope and return loss. Many new communications systems require very low sidelobe envelopes. This helps guarantee that interference with other communication links is controlled. Some manufacturers achieve this by placing an absorbing shroud about the perimeter of the reflector of the antenna. While relatively effective, the disadvantage of using the shroud is obvious. It increases the size, weight and cost of the antenna but with conventional designs it is the only way to guarantee low sidelobes.

The goal of the present invention is to maintain the low sidelobe envelope of the shrouded antenna without the use of an absorbing shroud. To do this we use a combination of a circular waveguide and a tapered, corrugated, non-planar subreflector that concentrates the energy from the waveguide onto the main reflector without allowing it to pass directly from the waveguide to the far-field of the antenna. We refer to the combination of the waveguide and subreflector as the antenna feed.

Usually, there are two ways energy can reach the far-field of the antenna without reflecting off the main reflector. It can propagate at such an angle that it hits neither the reflector nor the subreflector. This energy is often referred to as spill-over. The shrouded antenna eliminates this by absorbing the spill-over energy. The second way energy travels to the far-field is by wrapping, or diffracting, around the subreflector. The shrouded antenna reduces this somewhat by absorbing energy that diffracts in directions that the absorber subtends. It does not, of course, absorb energy that diffracts beyond the capture angle of the absorbing shroud, which is yet another disadvantage of that design.

Our invention uses an alternative two step approach to suppressing sidelobes. First we use a deep dish main reflector that does not allow appreciable stray feed radiation to directly reach the far-field. By deep dish we mean an antenna that has the subreflector located below the rim of the main reflector. Secondly, a shaped, corrugated subreflector, with corrugations of varying depth, as opposed to a flat corrugated subreflector, greatly reduces the edge diffraction from the subreflector, scattering by the feed tube and the reflection into the feed tube while maintaining a smooth feed pattern. The smooth feed radiation pattern can be efficiently formed into a directional beam with the main reflector. The varied depth of the corrugations and the non-planar design of the subreflector guide the reflected energy away from the feed to help insure a low sidelobe envelope. The publication by D. Olever, P. Clairicoate, A. A. Kishk, and L. Shafai entitled "Microwave Horns And Feeds," IEE Electromagnetic Waves, Series 39, discusses corrugations used as chokes in a horn antenna.

The preferred embodiment uses a small subreflector so as to minimize blockage. It must also illuminate the main reflector with a distribution that tapers off in power towards the reflector edges.

The invention therefore results in an improved reflector antenna which both reduces return loss back into the microwave feed and also results in subreflector energy being directed away from the waveguide, thus preventing scattering by the waveguide. The invention provides an antenna system with substantially reduced sidelobes and increased efficiency.

BRIEF DESCRIPTION OF THE DRAWING

The invention will be understood fully with reference to the drawing wherein.

DETAILED DESCRIPTION OF THE INVENTION

Figure 1:
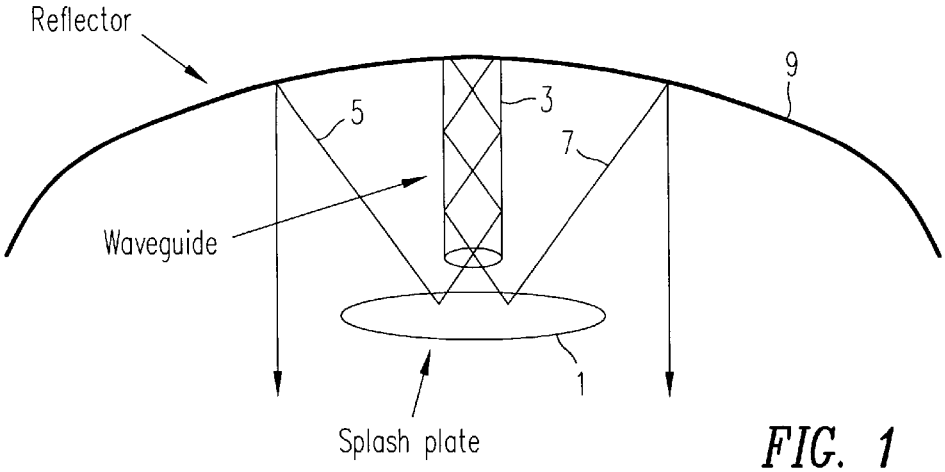
FIG. 1 (Prior Art)
FIG. 1 illustrates a prior art splash plate reflector antenna.
Figure 2:
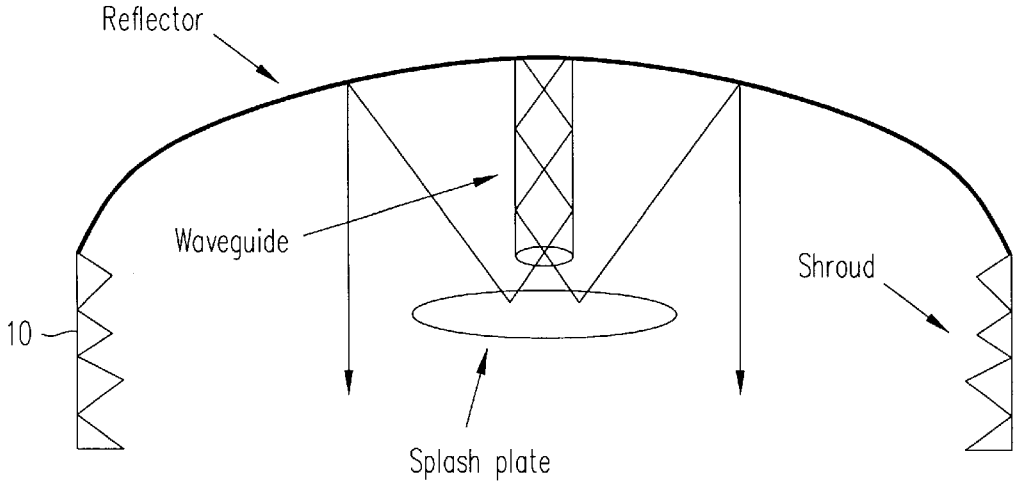
FIG. 2 (Prior Art)
FIG. 2 illustrates a prior art splash plate antenna employing an absorbing shroud.

A standard splash plate reflector antenna is seen in FIG. 1 and is characterized by a flat planar surface 1, called a splash plate, that reflects power radiated from a waveguide 3. This power, shown conceptually as 5 and 7, travels in the direction of a main reflector 9 that is approximately parabolic in shape. In order to achieve very low sidelobe envelopes some manufacturers place an absorbing shroud 10 about the perimeter of the reflector as shown in FIG. 2. The shroud is undesirable in that it increases the size, weight and cost of the antenna but it is the only way to guarantee low sidelobes in the prior art. If low sidelobes could be achieved without the disadvantages of a shroud the improvement would be substantial.

Figure 3:
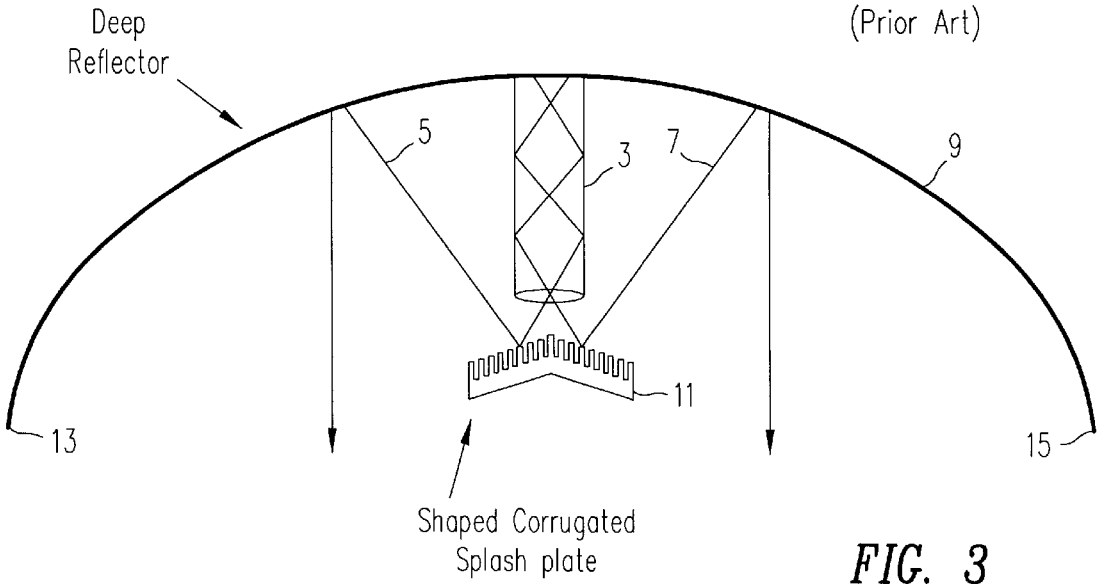
FIG. 3 shows a reflector antenna employing a non-planar, corrugated subreflector according to the invention.

FIG. 3 shows that our invention has two features which greatly reduce energy loss occasioned by reflecting off the main reflector at such an angle that it hits neither the main reflector nor the subreflector thereby spilling over to the far field; and by diffracting around the subreflector. A deep dish main reflector that does not allow appreciable stray feed radiation to directly reach the far-field is used. Additionally, a shaped, non-planar sub-reflector is embedded below the rim of the main reflector. A shaped (i.e., non-planar) corrugated subreflector greatly reduces the edge diffraction from the subreflector while maintaining a feed pattern that is smooth. As seen in FIG. 3, a preferred embodiment uses a small, peaked subreflector 11 which minimizes the reflector blockage. As will be explained in more detail subsequently, the subreflector will be essentially conically shaped and circularly symmetrical about the feed. Its location is such that it is below the plane containing the main reflector edge, indicated conceptually as the two side view edge points 13, 15. It must also illuminate the main reflector with a distribution that tapers off in power towards the reflector edges. The design is similar to Per-Simon Kildal's hat feed antenna but with an improved sidelobe envelope. While the goal of Kildal's antenna was to produce equal E- and H-plane patterns, Equal E and H-plane patterns are not a constraint in our invention. The goals of the present invention are to achieve greatly reduced sidelobes with good efficiency, and to minimize undesired reflections back into the feed. We achieve these goals, respectively, by the placement of the subreflector, and with a subreflector whose non-planar, or conical, geometry has corrugations of varying depths, as will be described in detail subsequently. The main reflector wraps around the feed and is near-parabolic. For example, the main reflector of the antenna will subtend a large portion of the feed pattern, such as 110 degrees. Typically, main reflectors subtend an angle of about fifty to sixty-five degrees. Stated another way, the focal length to diameter ratio (F/D) of our antenna is about 0.2 while most standard antenna designs have an F/D ratio that is much larger, from 0.6 to 1.5. Therefore, the feed pattern may have a large edge taper on the main reflector (−20 dB) that in turn gives a low sidelobe radiation pattern.

Figure 4:
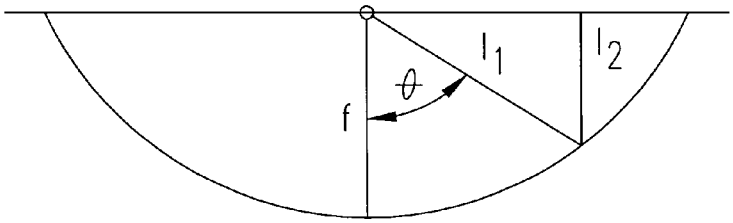
FIG. 4 is a representation of a parabola.

A manner of making the near-parabolic main reflector is as follows. It is well known that a parabola is a curve that defmes all equal distances between a line and a point. This is seen in FIG. 4. If reflector feed has a perfect phase center, it launches a spherical wave, with constant phase pattern. The parabola is the optimal reflector shape for this. However, our antenna does not have a perfect phase center. Instead the phase pattern varies with the angle θ. Hence the parabolic shape must be modified to correct for the phase variable of the feed. The new shape of the main reflector is defined by a curve that forces the following relationship:

$$l_1 + l_2 - \frac{\lambda \text{phase}(\theta)}{2\pi} = 2f$$

where:

f=the focus of the parabola $1_1$=length of line from the focus to the parabola $1_2$=length of line from a point on the fixed line to the parabola λ=wavelength Phase (θ)=Phase of feed pattern in radians The curve, which is near parabolic, is determined numerically.

Figure 5:
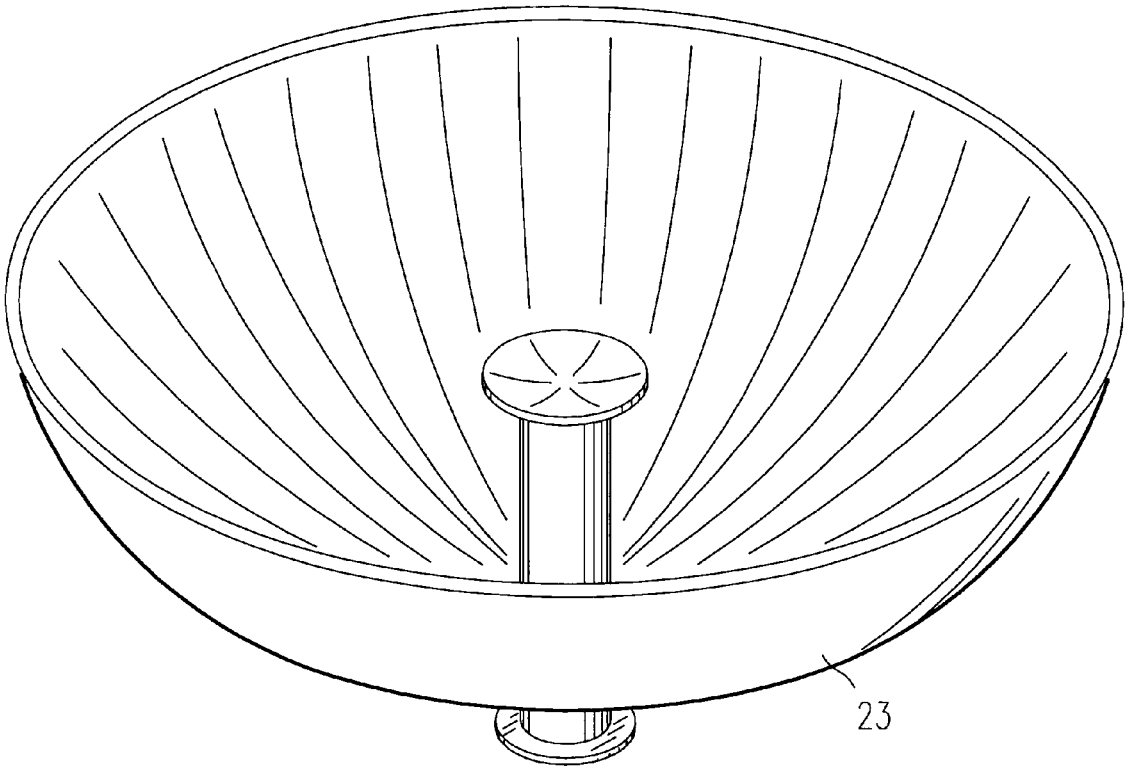
FIG. 5 illustrates the antenna of our invention showing the feed located below the rim of the main reflector.

The type of main reflector designed in accordance with the foregoing allows the waveguide feed to be placed below the rim of the reflector as described previously and as seen in FIG. 5. This gives the advantage of allowing the entire antenna to be covered by a flat radome because the deep dish rim is above the feed. This is a significant improvement because radome materials are difficult to process into shapes, and are expensive.

Figure 6:
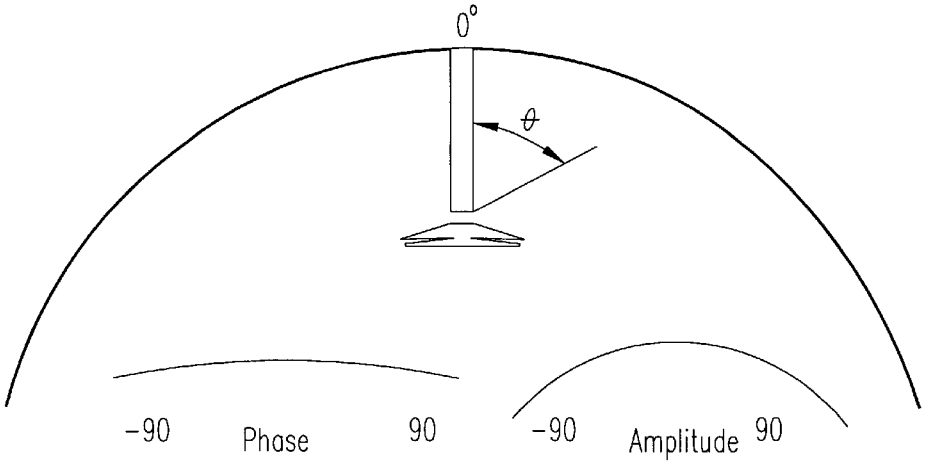
FIG. 6 illustrates the desired feed phase and amplitude which is realized by the invention.

In order to obtain good radiation characteristics from a reflector antenna the feed must have a smooth phase and amplitude radiation pattern. That is, if either the amplitude or (especially) the phase has a rapid "ripple" (i.e., variation as a function of angle), one cannot focus energy into the main reflector with resultant desired low sidelobe pattern. The phase pattern need not be flat, but should not have a rapid ripple. The desired feed pattern, showing a smooth phase and tapered amplitude distribution, in conjunction with a schematic representation of our antenna, is seen in FIG. 6.

Additionally, we must reduce the field that diffracts around the subreflector since this energy will propagate to the far-field and add to the sidelobe energy. One way we do this is to use corrugations of depth λ/4 near the rim of the subreflector because a corrugation of such depth acts as a choke to the electromagnetic energy propagating along the surface of the subreflector. A smooth amplitude feed pattern also requires a reduction in the resonance between the subreflector and feed tube which can be realized by directing the power away from the feed tube.

Figure 7A:
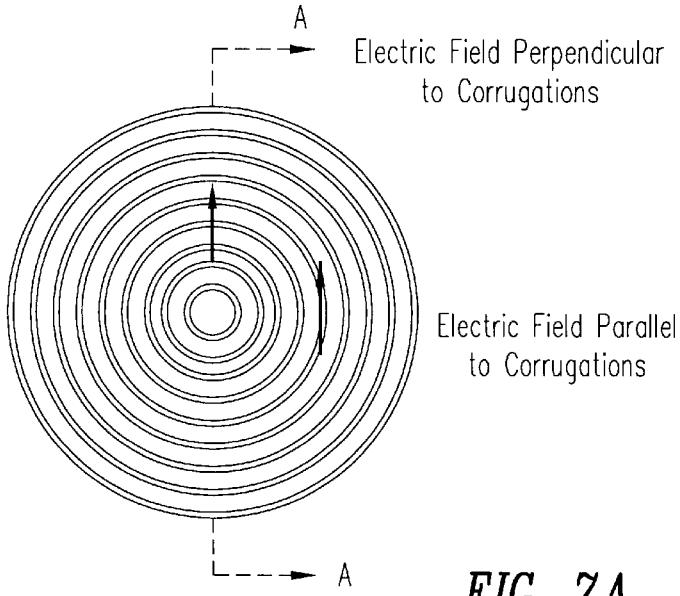
FIG. 7A shows a plan view of a non-planar, corrugated subreflector useful in of our invention, illustrating the behavior of the electric field associated therewith.
Figure 7B:
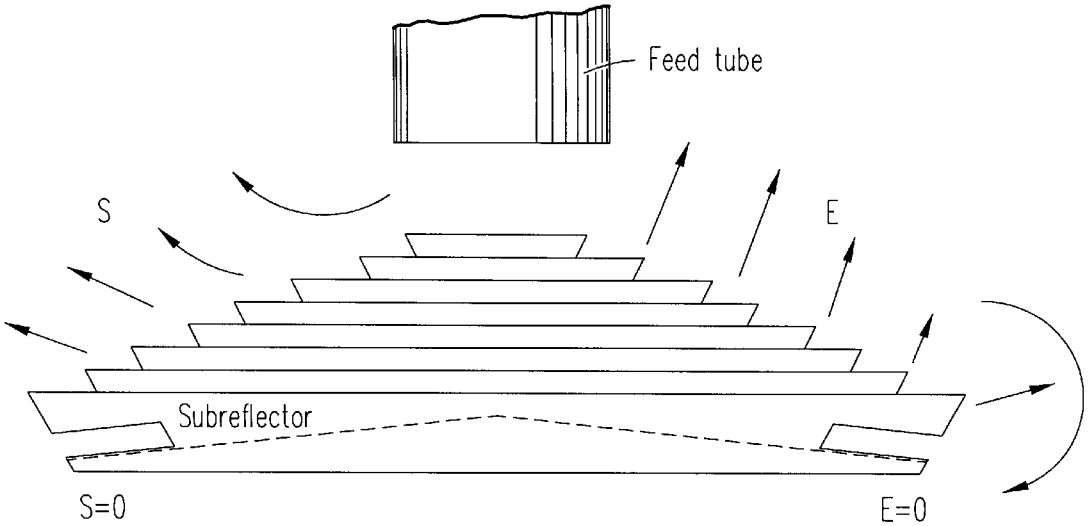
FIG. 7B shows a cross sectional view of the subreflector of FIG. 7A taken through section A—A, illustrating varied corrugation depth, diffraction suppression and power flow.

The subreflector is seen in view in FIG. 7A and is also seen in FIG. 7B, in a section view through A—A of FIG. 7A. When the electric field is aligned (parallel) with the corrugations, as shown in FIG. 7A, the surface acts as a perfectly conducting plane. The E-field induces currents on the tops of the corrugations that force the tangential fields to be zero. This is similar in effect to a solid conducting surface. So in this plane (i.e., the H-Plane) we rely on the sloping of the subreflector in essentially conical shape to guide the energy in the desired direction. Hence, along this axis the corrugations have no effect. In contrast, the corrugations form a reactive surface impedance when the electric field is perpendicular to the corrugations. The theory behind this is well known to those of ordinary skill in the antenna art. For a review of that theory, the reader is referred to the paper by N. M. Johansson and J. R. Sanford, entitled "Characterization of Artificially Anisotropic Surfaces Using Waveguide Simulator Techniques," Antennas and Propagation Symposium, Seattle, Wash. 1994.

Because of the circular symmetry of our antenna, it is not polarization sensitive. Instead it is polarization robust and can support any sense of signal polarization. For example, one can induce dual orthogonal linear polarization such as can be achieved using an ortho-mode junction. One can also induce circular polarization with two orthogonally linear fields spaced ninety degrees apart in time and space. Further, any linear polarity can be supported such as vertically linear, horizontally linear or other desired angle of linear polarity.

An approximate formula for the surface impedance of a corrugated surface is given by $$Z = \frac{E}{H} \approx j377 \tan\frac{2\pi d}{\lambda}$$

where d is the depth of the corrugation

Corrugations with a depth slightly less than a quarter wavelength form an inductive surface impedance while corrugations greater than a quarter wavelength form a capacitive surface impedance. At one quarter wavelength depth the corrugations form a choke ($Z=\infty$) that is effectively a barrier to surface wave propagation. An inductive surface impedance allows a surface wave to propagate along the surface. We use this characteristic in close to the feed tube, i.e., at the center of the subreflector surface, to guide the energy away from the center of the subreflector. Farther out from the center of the subreflector we use quarter wavelength corrugation depths which act like chokes to launch the surface wave into a radiating mode. Thus, we achieve the desired amplitude distribution seen in FIG. 6.

Figure 8:
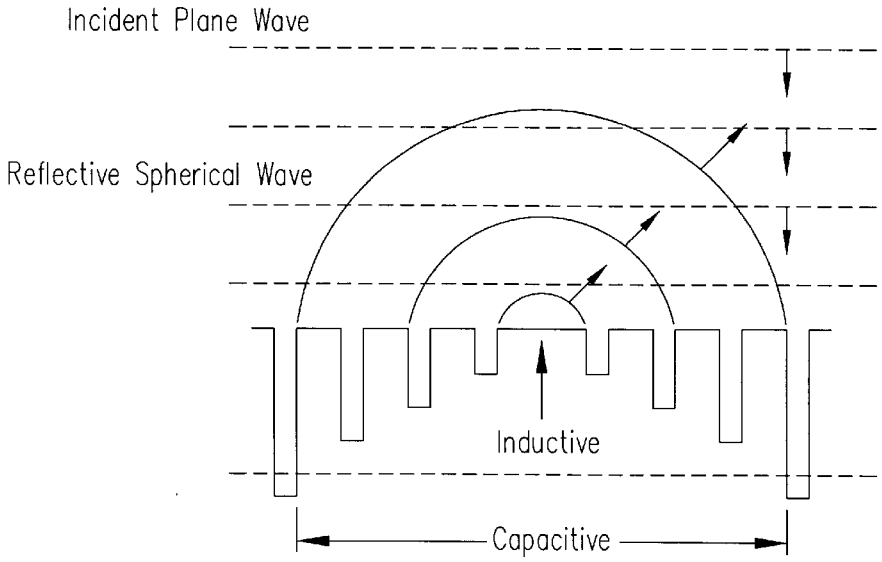
FIG. 8 shows in conceptual form the reflection of a plane wave from a surface having corrugations of varying depth.

The manner in which energy is directed by our subreflector can be additionally understood with reference to the following explanation which refers to FIG. 8. When the electric field is transverse to the corrugations, the corrugations are transparent to the field. Hence, the depth of the corrugations can be fashioned in such a way as to reflect an incident plane wave, shown in dash line, into a reflected spherical wave, shown in solid line. The arrows of the plane wave indicate generally the direction of incidence and the arrows of the spherical wave indicate the direction the power travel of the reflected spherical wave. That is, the use of corrugations of varying depth gives an additional degree of design freedom; namely, corrugation depth or corrugation taper.

Figure 9:
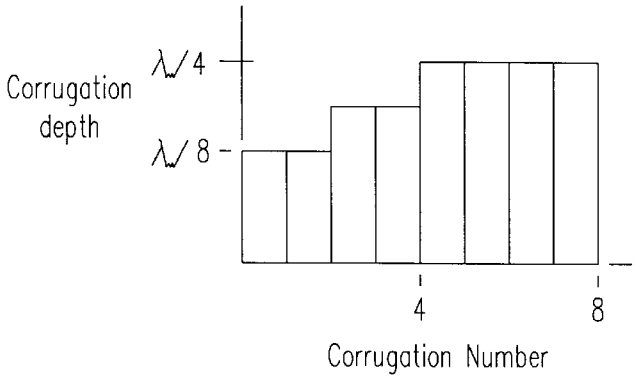
FIG. 9 shows the corrugation profile of the subreflector of FIG. 7A and FIG. 7B.

In our invention the corrugations are either shallower or non-existent toward the center of the subreflector as seen in the corrugation depth profile of FIG. 9. This means that area exhibits an inductive impedance. The deeper corrugations toward the outside of the subreflector gives a capacitive impedance. Thus a subreflector made according to our invention can guide a plane wave in the desired direction, reflecting a smaller amount of energy back into the feed tube and most of the energy in the desired direction.

FIG. 7B shows a side view of the subreflector of our invention taken, along section A—A of FIG. 7A, in conjunction with the feed tube. In practice both are connected by an attachment structure. The figure also shows the electric field, E, normal to the surface of our subreflector and power flow lines, S (the Poynting Vector) associated therewith. Both are symmetric about the structure. Towards the center of the reflector a surface wave propagates, as indicated by the large electric field lines and power lines along the subreflector surface. The corrugations of varying depth suppress the field in the directions in which it is not desired. The increasing depth of the corrugations reduces the normal electric field as the field approaches toward the perimeter of the subreflector and does not allow energy to reach the back of the subreflector. This in turn reduces the sidelobes since the stray spillover power scattered from the subreflector is reduced. An additional corrugation in the edge of the subreflector further reduces spillover. Also seen in FIG. 7B is the space behind the subreflector which is a volume of revolution in the shape of a cone that makes an angle with a normal axis through the center of the cone. The conical shape of the internal portion of the subreflector could also be frustro-conical. In our preferred embodiment the angle is 160° although this is not critical.

Had the subreflector been solid, without corrugation, the E-field would remain approximately constant and would not diminish appreciably in value. In accordance with the depth profile of FIG. 9, corrugations progressing outward from the center exhibit reactance which becomes more and more inductive until the corrugations become $\lambda/4$ at which point the surface becomes capacitive. Hence, the corrugations suppress more of the surface wave as one progresses outwardly from the center of the subreflector and corrugations of $\lambda/4$ depth toward the edge suppress the surface wave dramatically since they function as chokes. The additional $\lambda/4$ depth corrugation in the subreflector's edge or sidewall shown in FIG. 7B helps prevent the E-field from wrapping around the subreflector and proceeding directly to the far field. In this overall manner, power can be guided or steered away from the far field and directed to the main reflector for operation in a manner producing the desired low sidelobe pattern.

Also, in conjunction with the surface impedance we shape the subreflector in order to provide desired primary reflection from the feed that is easily focused by the main reflector, as shown by FIG. 7B. Like the corrugation taper, this further reduces the power scattered by the feed tube and therefore provides a smoother phase and amplitude distribution. Likewise, it reduces the power coupled back into the feed tube. This is especially true in the plane where the corrugations are parallel to the E-field because the corrugation taper has no effect.

Figure 10:
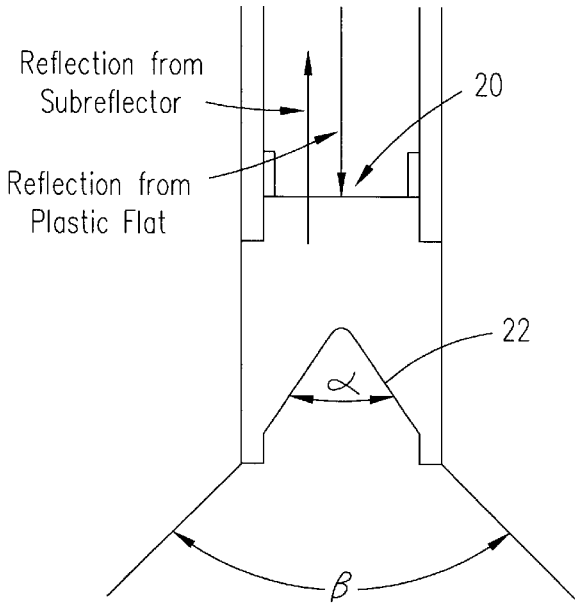
FIG. 10 is a illustration of a plastic flat useable in our invention.

While energy may still be directed from the center of the subreflector back into the feed tube, this can be minimized by the plastic support piece of FIG. 10. The support piece has a plastic flat of the proper size placed at the proper position such that energy directed from the center of the subreflector back into the feed tube is cancelled so as not to be a substantial detriment to desired operation. That is, the plastic flat is designed and placed to produce energy of equal magnitude of, and opposite phase to, that energy reflected from the center area of the subreflector. In this regard the energy at the air to plastic interface can be calculated. The reflected energy from the subreflector can be measured. Hence one can design the plastic flat bigger or smaller, tapering from the diameter of the waveguide to the desired diameter of the flat, and positioned at a depth within the waveguide to result in the desired cancelling of the reflections. This can be done by combining optimization techniques with a rigorous electromagnetic analysis. One such method is seen in the paper by A. A. Kishk entitled "Electromagnetic Scattering From Composite Object Using A Mixture of Exact and Impedance Boundary Conditions," IEEE Transactions On Antennas and Propagation, Vol. AP-39, No. 6, pp. 826–833, June, 1991; and the report by A. A. Kishk entitled "Scattering and Radiation From Multi-Homogeneous Dielectric Regions Partially Coating Conducting Surfaces Using Method of Moments", Software User's Guide, July, 1995.

In the illustration of FIG. 10, the flat on the plastic spacer is roughly the inner diameter of the tube. It is also seen in that figure that our subreflector has a generally conical front portion. The conical angle β is 150 degrees in one embodiment of our invention.

The angle is designed to insure that there is little energy in the direction of the waveguide feed and helps insure that energy from the feed in $TE_{11}$, mode is directed back toward the main reflector. The combination of the varied corrugation depth seen in FIG. 9 and the shape of the subreflector determines the extent to which the energy is directed away from the feed. The angle α of our subreflector, used for impedance matching with the waveguide, is 115°.

Our invention finds use in cellular communications. These type of systems require the placement of base stations every few miles and normally operate at a frequency under 2 GHz. The data received by these base stations must be transmitted by the stations. Higher frequencies, such as 38 GHz, radio links are used for this. The FCC and other international regulating commissions require a low sidelobe envelope for these antennas due to the large number of antennas. Such an envelope is exhibited by the antennas of our invention.

Newly proposed reception-transmission satellite systems will offer two-way communications rather than simple reception. These new satellite systems require antennas to produce beams with low sidelobes to avoid interference problems. the antenna of our invention can meet this requirement.

In addition, business parks are implementing high speed data links between buildings, often for internet-like communications. The most economical way to implement such links is with millimeter wave radios and the appropriate antenna. Here, too, the above regulating commissions require very low sidelobes such as those exhibited by the antenna of our invention.

While the present invention has been described with reference to a specific embodiment, the description is illustrative of the invention and is not to be construed as limiting invention. Various modifications may occur to those skilled in the art without departing from the true spirit and scope of the invention as defined by the appended claims.

What is claimed is:

1. An antenna system comprising:

a nearly parabolic main reflector having a focus below its rim;

a waveguide having one end attached to said main reflector at an axis passing normally through substantially the center of said main reflector, the other end of said waveguide located near the focus of said main reflector; and a symmetrically peaked corrugated subreflector with corrugations that vary in depth and with an additional corrugation located within its edge surface attached symmetrically to said other end of said waveguide, wherein said antenna system is operating at any sense of signal polarization.

2. An antenna system comprising:

a main reflector, a waveguide having one end attached to said main reflector at an axis passing normally through substantially the center of said main reflector, the other end of said waveguide located near the focus of said main reflector; and a corrugated, symmetrically non-planar subreflector having corrugations which vary in depth wherein the depth and placement of said corrugations guide energy from said waveguide in desired directions and wherein said subreflector has a corrugation within its edge surface, symmetrically attached to said other end of said waveguide.

* * * * *